US008643285B2

(12) United States Patent
Pan

(10) Patent No.: US 8,643,285 B2
(45) Date of Patent: Feb. 4, 2014

(54) CONSTANT TEMPERATURE LIGHT EMITTING DIODE LIGHTING SYSTEM

(76) Inventor: Yang Pan, Singapore (SG)

( * ) Notice: Subject to any disclaimer, the term of this patent is extended or adjusted under 35 U.S.C. 154(b) by 168 days.

(21) Appl. No.: 13/350,772

(22) Filed: Jan. 14, 2012

(65) Prior Publication Data

US 2013/0181611 A1 Jul. 18, 2013

(51) Int. Cl.
*H05B 37/02* (2006.01)

(52) U.S. Cl.
USPC ..... 315/151; 315/149

(58) Field of Classification Search
None
See application file for complete search history.

(56) References Cited

U.S. PATENT DOCUMENTS 7,414,370 B2 8/2008 Kunjappan
7,450,028 B2 11/2008 De Godzinsky
7,791,285 B2 9/2010 Wu
2008/0062070 A1 3/2008 De Oto et al.
2010/0141153 A1* 6/2010 Recker et al. ..... 315/149
2010/0141159 A1 6/2010 Shiu et al.
2010/0176746 A1 7/2010 Catalano et al.
2010/0265064 A1 10/2010 Mayer et al.
2010/0277077 A1 11/2010 Pong et al.
2010/0289410 A1* 11/2010 Wu et al. ..... 315/112
2011/0133655 A1* 6/2011 Recker et al. ..... 315/159
2011/0199013 A1 8/2011 Cottrell
2011/0241572 A1 10/2011 Zhang et al.

* cited by examiner

*Primary Examiner* — Crystal L Hammond

(57) ABSTRACT

A power management system for a lighting system including at least one lighting emitting diode is disclosed. In one embodiment, the light emitting diode(s) of the lighting system are operated under a constant temperature. In another embodiment, the light emitting diode(s) of the lighting system are operated under a constant temperature difference to the ambient temperature. A thermal feedback loop is employed to achieve the constant temperature or the constant temperature difference.

20 Claims, 7 Drawing Sheets

CONSTANT TEMPERATURE LIGHT EMITTING DIODE LIGHTING SYSTEM

CROSS-REFERENCE TO RELATED APPLICATIONS

Not applicable

BACKGROUND

1. Field of Invention

This invention relates to a lighting system, specifically to control system and circuit for a light emitting diode (LED) lighting system operated under a constant temperature.

2. Description of Prior Art

In recent years, concerns have been raised that high demand for electricity taxing the capacity of existing electricity generating plants. Furthermore, concerns regarding the availability and environmental safety of fossil and nuclear fuel are being raised. As a result of the above factors, the price of electricity has been on a path of steady increasing. It has become increasingly common to seek low power consumption electrical appliances. LED has increasingly been employed as light sources for homes and for street lights.

LED has long operating lifetimes in relation to conventional incandescent and fluorescent light sources. Despite their advantages and increased usages, LED at an elevated temperature is susceptible to degradation of performance and/or lifetime. For example, a LED operated at an elevated temperature at 80C or above can experience significant degradation.

Therefore, there exists a need to control the operating temperature of LED lighting system in order to maintain optimized performances and to achieve a desired long lifetime.

SUMMARY OF THE INVENTION

It is therefore an object of the present invention to provide a LED lighting system operated under a constant temperature.

It is another object of the present invention to provide a constant temperature control system and circuit based upon a thermal feedback loop.

An exemplary LED lighting system comprises at least one LED strip that includes multiple LED's. The LED strip is coupled to a power supply through a power management circuit. The power management circuit includes a comparator that takes one of its inputs from a reference and takes another input from a temperature sensor. In one embodiment, the temperature sensor is on a chip that is placed in a close proximity to the LED strip to measure operating temperature of the LED's. In another embodiment, the temperature sensor is a part of at least one of the LED chips. The output of the comparator is coupled to a power modulator that converts an incoming DC power into a pulse width modulation (PWM) form or into a bit stream form. An output of the power modulator is connected to the LED strip to supply its operation power. The power depends on a duty cycle or a bit rate of the modulated power. If the LED's are overheated, the output of the temperature sensor turns the output of the comparator into a low voltage level that switches off the power supply to the LED's. In response to switching off of the supply power, the measured temperature of the temperature sensor starts to drop that will turn the output of the comparator to a higher voltage level that will switch on the power supply to the LED strip. Therefore, the temperature will oscillate around a value determined by the reference. In one aspect, the reference is generated by a controller.

In one aspect, the temperature sensor may be a diode, a transistor or a resistor of an integrated circuit. In another aspect, the temperature sensor is a device in the same chip as at least one of the LED chips. In yet another aspect, the temperature is an infrared detector that measures radiation generated from the LED's caused by heating.

In another embodiment, a temperature difference between the operating temperature of LED's and the ambient temperature is controlled to be a constant.

In another aspect, the temperature or the temperature difference is changeable by the controller. Furthermore, the controller may receive a control signal from a remote control and changes the temperature or the temperature difference accordingly.

BRIEF DESCRIPTION OF THE DRAWINGS

For a more complete understanding of the present invention and its various embodiments, and the advantages thereof, reference is now made to the following description taken in conjunction with the accompanying drawings.

DETAILED DESCRIPTION

The present invention will now be described in detail with references to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order not to unnecessarily obscure the present invention.

Figure 1:
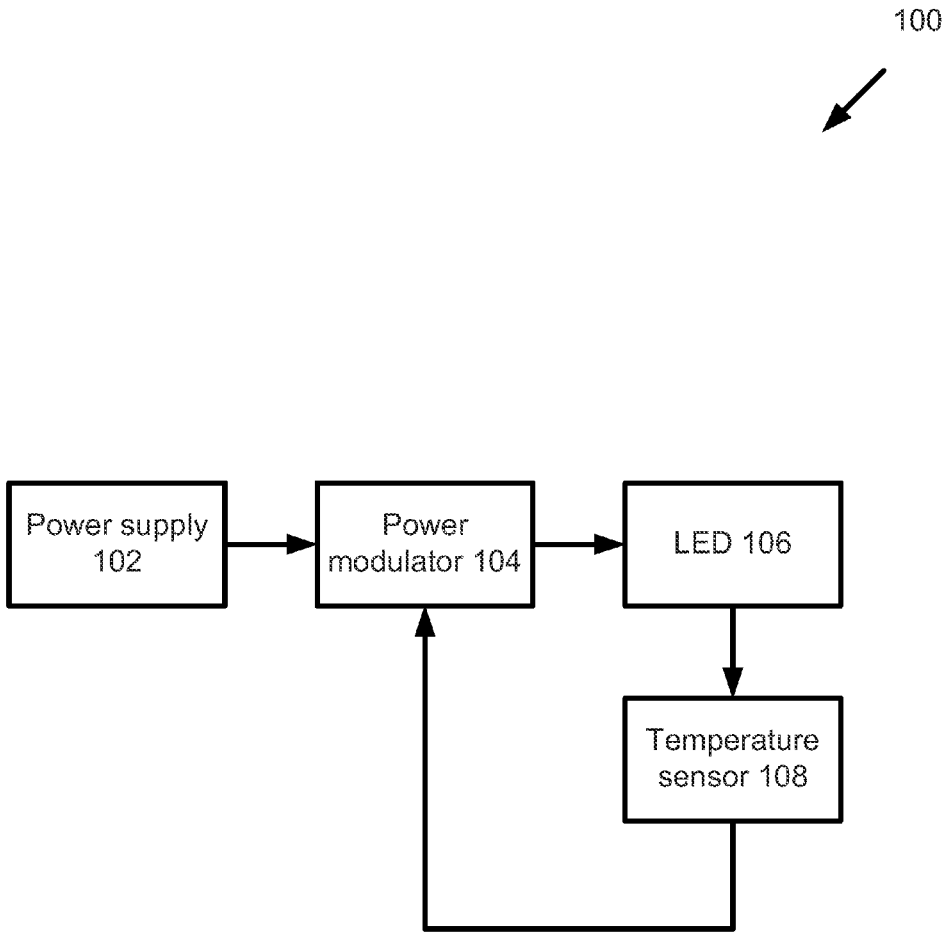
FIG. 1 is a schematic diagram of an exemplary LED lighting system.

FIG. 1 is a schematic diagram of an exemplary LED lighting system. System 100 includes a power supply 102, a power modulation unit 104 and a LED 106. Power supply 102 may be an AC power supply. Power supply 102 may also be a DC power supply including a DC power source converted from an AC power source through an AC/DC converter. The DC power supply may also include a battery and an alternative power source, such as, for example, a solar power generation system. LED 106 may include one or more LED's. Power modulation unit 104 converts an incoming power into a desired form, such as, for example, into a pulse width modulation (PWM) or a bit stream form. A temperature sensor 108 measures operating temperature of LED 106. Temperature sensor 108 is coupled to power modulation unit 104 that adjusts its output based upon the measured temperature. Temperature sensor 108 may be a diode or a transistor placed in an integrated circuit chip that is placed in a proximity to the LED. Temperature sensor 108 may also be a resistor, such as, for example, a poly-crystalline silicon resistor or a resistor formed by a diffused layer in a typical integrated circuit process. Temperature sensor 108 may even be an infrared detector that detects radiation emitted from a heated LED chip based upon well known black-body radiation principle. In another aspect, the temperature sensor 108 may also be a part of at least one LED chip.

Figure 2:
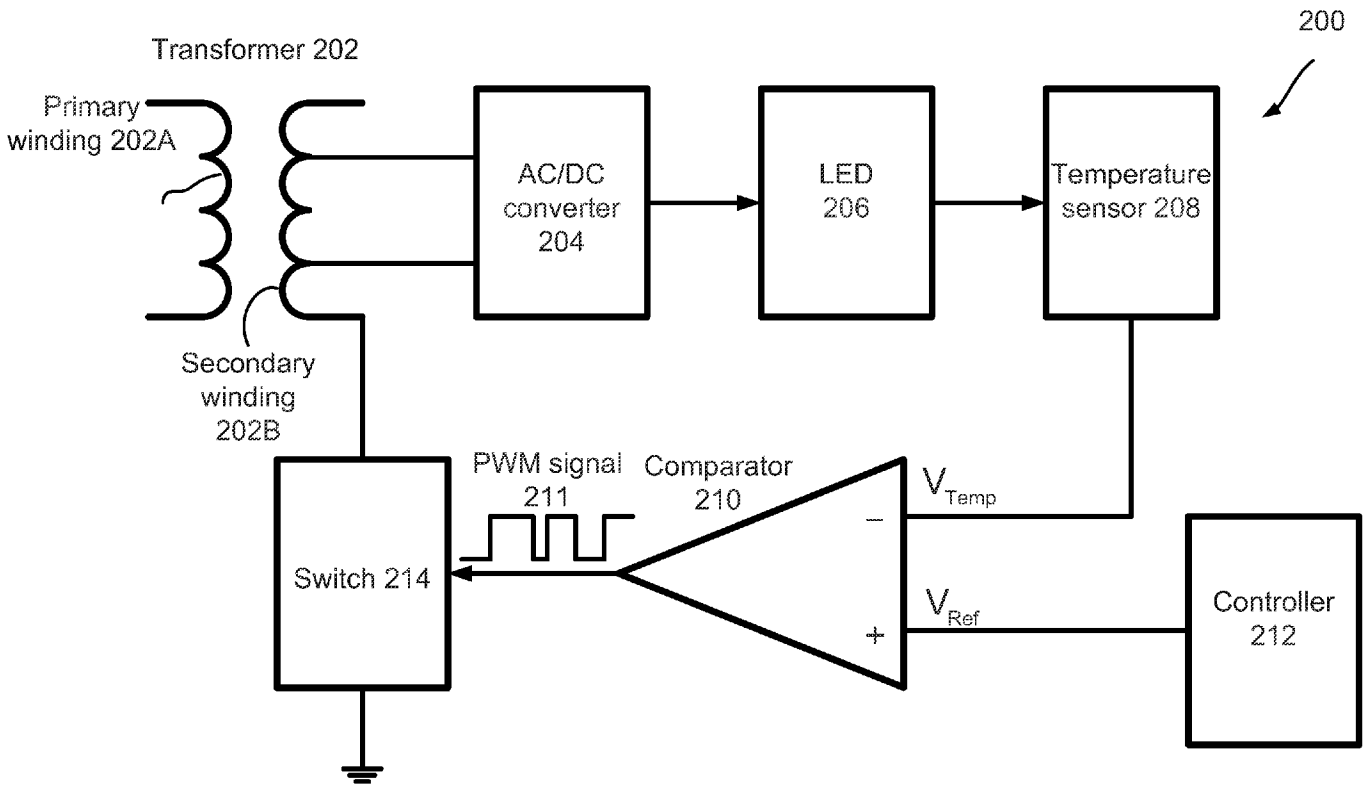
FIG. 2 is a schematic diagram of functional blocks of an exemplary temperature control circuit in PWM form based upon a thermal feedback loop in AC power domain.

FIG. 2 is a schematic diagram of functional blocks of an exemplary temperature control circuit in PWM form based upon a thermal feedback loop in AC power domain.

Such an implementation is known from an article by Pan (the present inventor) and Huijsing in Electronic Letters 24 (1988), 542-543. This circuit is theoretically appropriate for measuring physical quantities such as speed of flow, pressure, IR-radiation, or effective value of electrical voltage or current (RMS), the influence of the quantity grated integrated circuit (chip) to its environment being determined in these cases. In these measurements, a signal conversion takes place twice: from physical (speed of flow, pressure, IR-radiation or RMS value) to the thermal domain, and from the thermal to the electrical domain.

This known semiconductor circuit theoretically consists of a heating element, integrated in the circuit, and a temperature sensor. The power dissipated in the heating element is measured with the help of an integrated amplifier unit, an amplifier with a positive feedback loop being used, because of which the temperature oscillates around a constant value with small amplitude. In the known circuit the temperature will oscillate in a natural way because of the existence of a finite transfer time of the heating element and the temperature sensor with a high amplifier-factor.

FIG. 2 shows a novel implementation of the thermal feedback principle as mentioned above to a control system to operate a LED lighting element at a constant temperature. Control system 200 comprises a transformer 202 including primary winding 202A and secondary winding 202B. Transformer 202 converts AC power with high amplitude in primary winding 202A to AC power with low amplitude in secondary winding 202B while maintaining the power almost constant. AC power is converted to DC power by AC/DC converter 204. The output DC power may be processed further in a form suitable to drive LED 206 (not shown in the figure). Temperature sensor 208 measures operating temperature of LED 206. The measured temperature may be an approximation of junction temperature of LED 206 if temperature sensor 208 is placed in the proximity of LED 206.

Output of temperature sensor 208 is coupled to one input of comparator 210. Reference generated by controller 212 is coupled to another input of comparator 210. Output of comparator 210, which is a PWM signal, is coupled to switch 214 that is connected to secondary winding 202B of transformer 202 to form a feedback loop. Switch 214 may be implemented in various forms as known in the art. Switch 214 maybe a power Metal Oxide Semiconductor Field Effect Transistor (MOSFET) according to an implementation. Switch 214 may be a bipolar transistor according to another implementation. As soon as the measured temperature by temperature sensor 208 exceeds a predetermined value, set by the reference, the output of the comparator switches off switch 214. As a result, AC/DC converter 204 receives no power from secondary winding 202B and the output of temperature sensor 208 starts to drop. As soon as the output is below the reference, the output of comparator 210 switches on switch 214 and therefore secondary winding 202B. The temperature of the chip or the microstructure will oscillate within a small value. The output power of secondary winding 202B will remain as a constant in a sine wave form modulated by the PWM signals. The output power of transformer 202 is limited by the duty cycle of the PWM signal.

The maximum output power of transformer 202 is determined by the reference that sets a level of temperature that the chip or the microstructure will oscillate around. To sustain a higher temperature, the output power from AC/DC converter 204 will need to draw more power from the secondary winding 202B. The reference is determined by controller 212.

Figure 3:
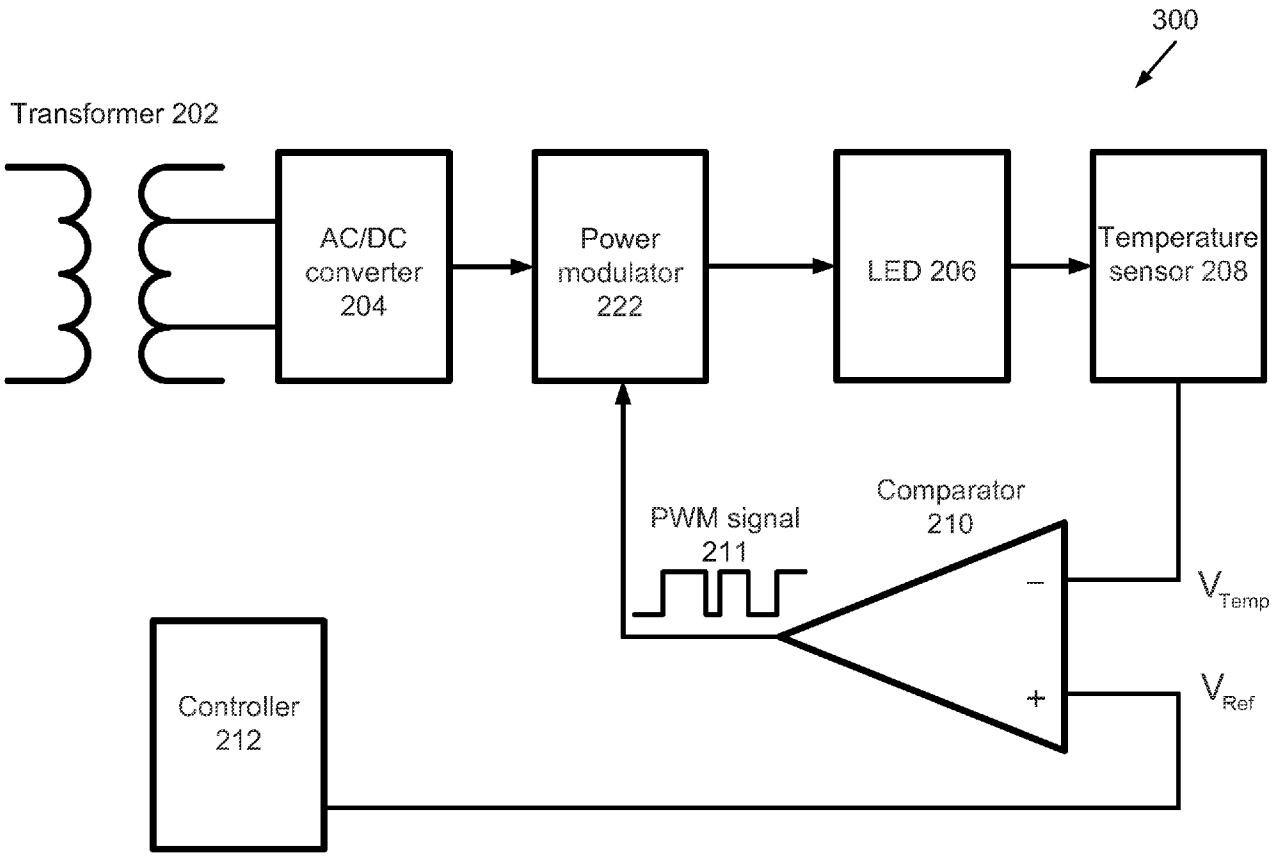
FIG. 3 is a schematic diagram of functional blocks of an exemplary temperature control circuit in PWM form based upon a thermal feedback loop in DC power domain.

FIG. 3 is a schematic diagram of functional blocks of an exemplary temperature control circuit in PWM form based upon a thermal feedback loop in DC power domain. System 300 comprises AC/DC converter 204 that converts output power of transformer 202 from AC form into DC form. Power modulator 222 converts the DC power into PWM form. The power in PWM form is coupled to power LED 206. In one aspect, temperature sensor 208, placed in the proximity of LED 206, measures temperature of the microstructure (chip) that is an approximation of a junction temperature of LED 206. Comparator 210 takes one input from the output of temperature sensor 208 and takes another input from a reference generated from controller 212. Output of comparator 210 in PWM form (211) is coupled to power modulator 222 to modulate the DC power. The temperature of the chip will oscillate within a small value set by the reference. Power modulator 222 converts output of AC/DC converter 220 into the power in PWM form. The output power of power modulator 222 is therefore determined by duty cycle of the PWM signal while the amplitude is kept constant.

Figure 4:
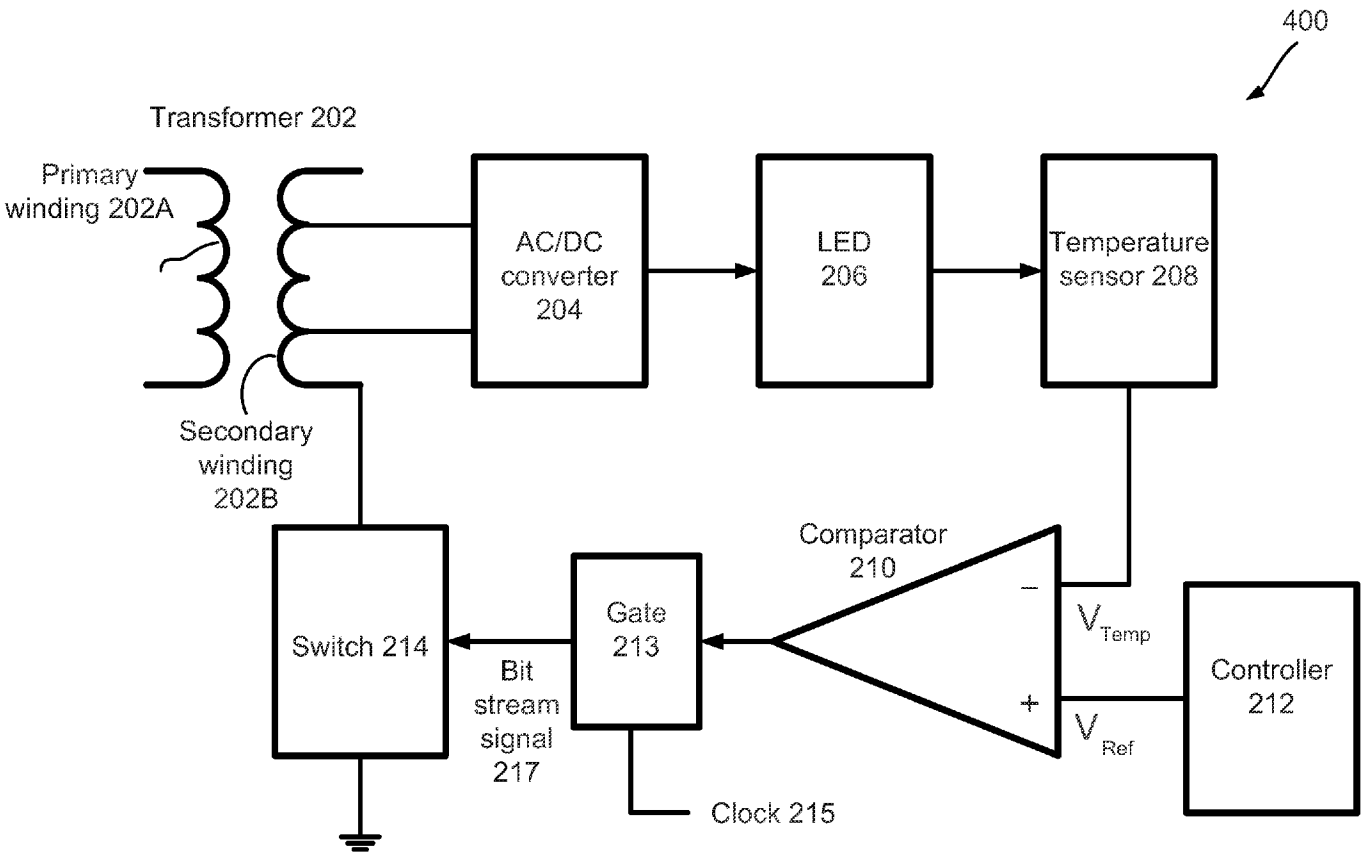
FIG. 4 is a schematic diagram of functional blocks of an exemplary temperature control circuit in bit stream form based upon a thermal feedback loop in AC power domain.

FIG. 4 is a schematic diagram of functional blocks of an exemplary temperature control system 400 in bit stream form based upon a thermal feedback loop in AC power domain. In comparison to the embodiment as shown in FIG. 2, a gate 213 is added in between comparator 210 and switch 214. The signal, as the output of comparator 210, in PWM form is further modulated by a clock 215 and is converted into bit stream form (217). Therefore, the output of transformer 202 is modulated by the bit stream signal 217 before it is converted into DC form and is further delivered to drive LED 206.

Figure 5:
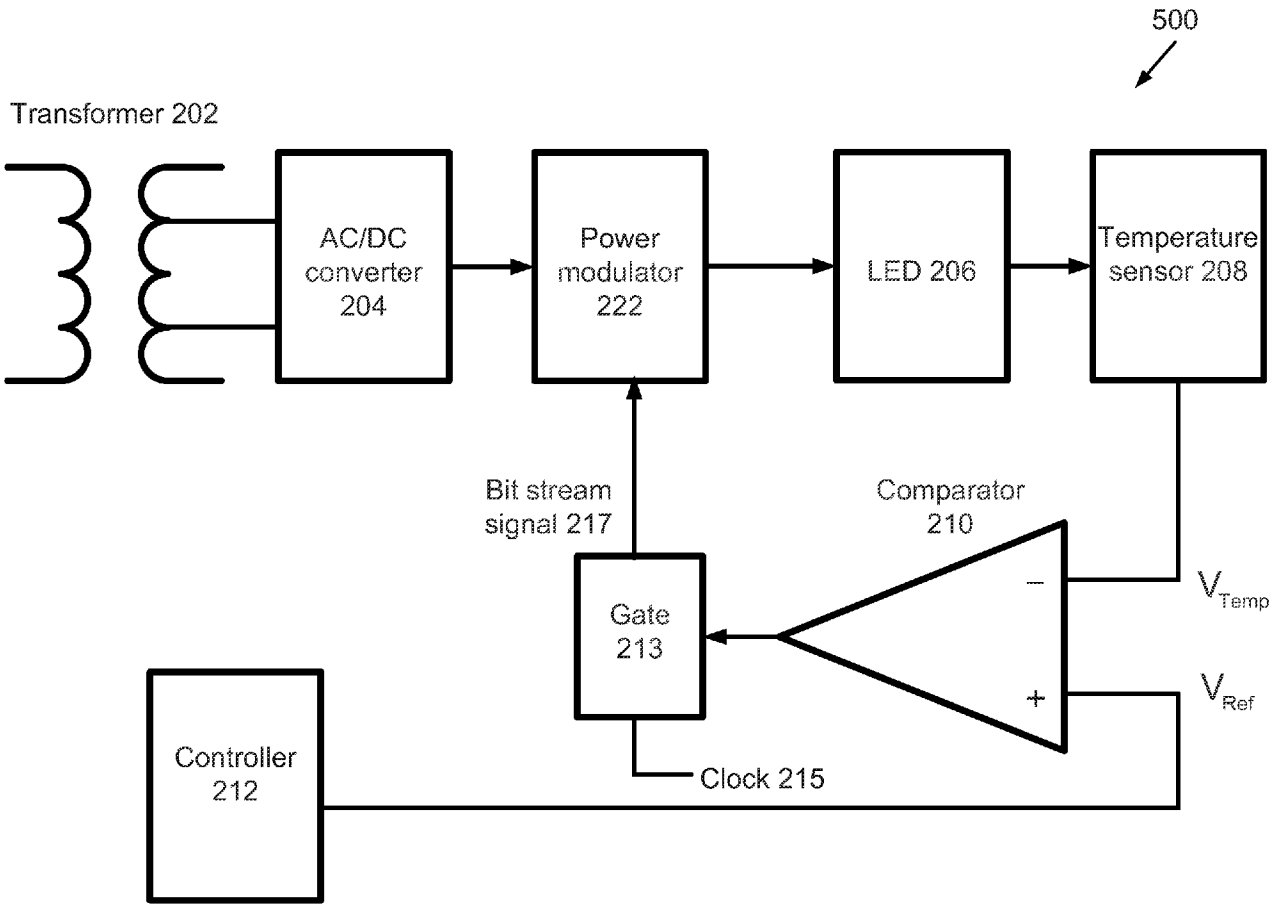
FIG. 5 is a schematic diagram of functional blocks of an exemplary temperature control circuit in bit stream form based upon a thermal feedback loop in DC power domain.

FIG. 5 is a schematic diagram of functional blocks of an exemplary temperature control system 500 in bit stream form based upon a thermal feedback loop in DC power domain. In comparison to the embodiment as illustrated in FIG. 3, a gate 213 is added in between the output of comparator 210 and power modulator 222. The signal, as the output of comparator 210, in PWM form is further modulated by a clock 215 and is converted into bit stream form (217). Therefore, the output of power modulator 222 is a power modulated by bit stream signal 217. In one aspect, the power modulated by bit stream signal 217 is delivered to drive LED 206 directly. In another aspect, the power in the bit stream form is converted into DC power before it is delivered to drive LED 206.

Figure 6:
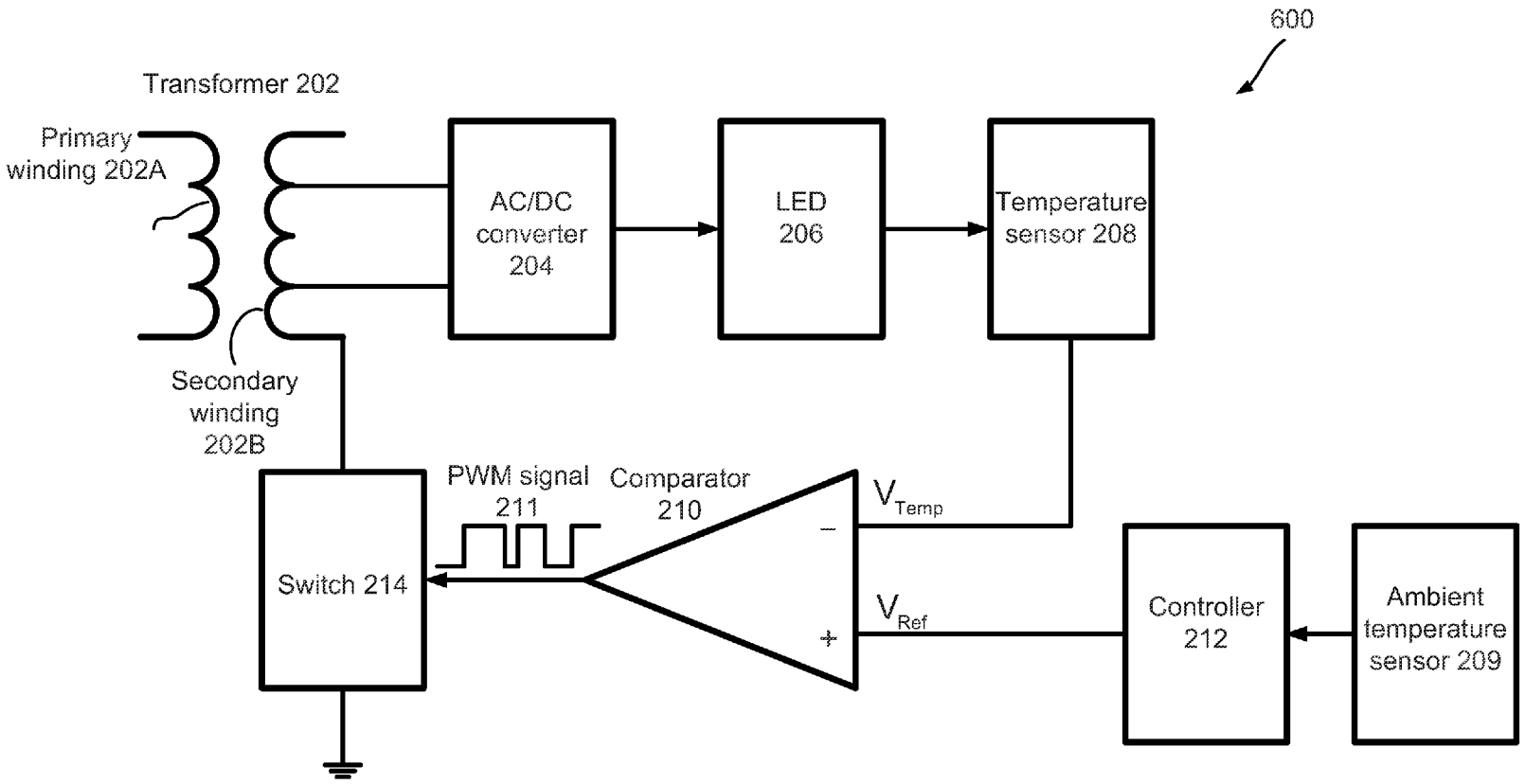
FIG. 6 is a schematic diagram of functional blocks of an exemplary temperature difference control circuit in PWM form based upon a thermal feedback loop in AC power domain.

FIG. 6 is a schematic diagram of functional blocks of an exemplary temperature difference control system 600 in PWM form based upon a thermal feedback loop in AC power domain. In comparison to the embodiment as illustrated in FIG. 2, an ambient temperature sensor 209 is added to measure the ambient temperature. Controller 212 receives measurement result from ambient temperature sensor 209 and generates the reference voltage. In one aspect, the reference voltage changes linearly with the ambient temperature. LED 206 will be operated under a constant temperature difference (to the ambient) rather than under the constant temperature.

The ambient temperature sensor may also be added to the embodiments as illustrated in FIGS. 3-5 to operate LED under the constant temperature difference to the ambient temperature.

Figure 7:
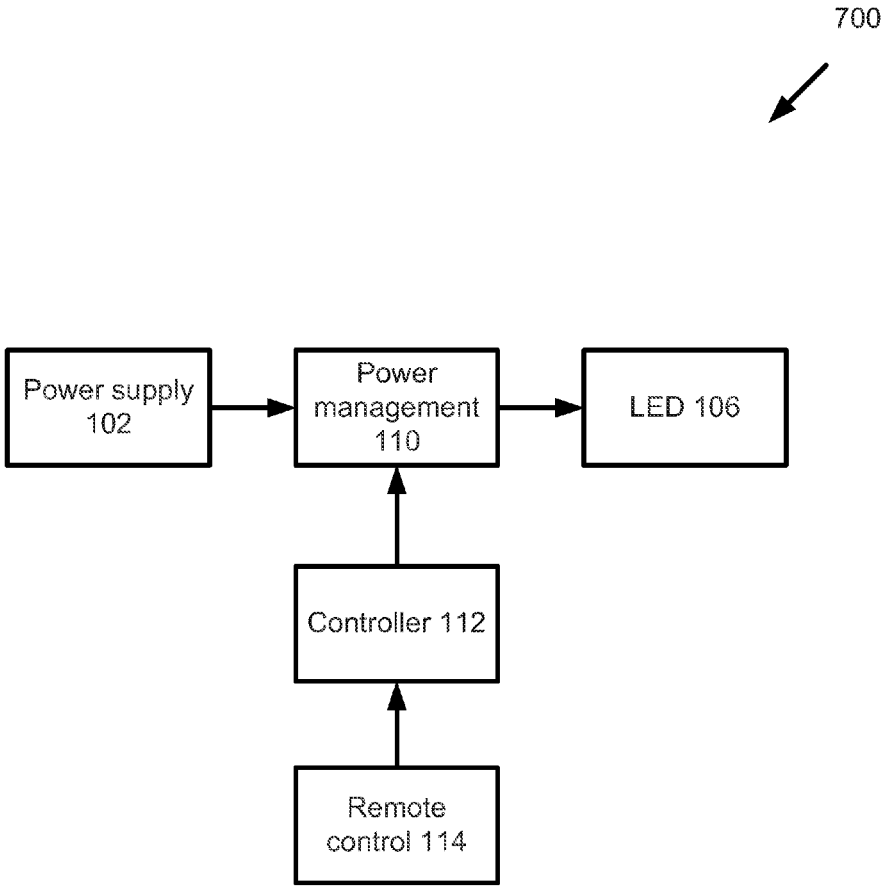
FIG. 7 is a schematic diagram of an exemplary LED lighting system including a remote control.

FIG. 7 is a schematic diagram of an exemplary LED lighting system 700 including a remote control. As shown in FIG. 7, power supply 102 is coupled to LED 106 through a power management unit 110. A controller 112 is coupled to unit 110 for controlling its operations. A remote control 114 is coupled to controller 112 wirelessly. In one aspect, one of the exemplary power control systems as shown in FIGS. 2-6 is employed. A user operates remote control 114 to change the operating temperature or the operating temperature differences through the voltage reference generated by the controller. Illumination of LED 106 can be adjusted accordingly.

The invention claimed is:

1. A light emitting diode lighting system comprising:

(a) at least one light emitting diode;

(b) a power supply; and (c) a closed feedback loop connected between an output and a first input of a comparator pertaining to controlling operating temperature of said light emitting diode to oscillator around a predetermined value, said first input is coupled to an output of a temperature sensor pertaining to measuring temperature of said light emitting diode, said predetermined value is set by a second input of the comparator, said second input is coupled to an ambient temperature sensor.

2. The system as recited in claim 1, wherein said temperature sensor is a part of said light emitting diode.

3. The system as recited in claim 1, wherein said temperature sensor is integrated in a single chip as said light emitting diode.

4. The system as recited in claim 1, wherein said temperature sensor is placed in proximity of said light emitting diode.

5. The system as recited in claim 1, wherein said temperature sensor comprises an infrared sensor.

6. The system as recited in claim 1, wherein the output of the comparator is coupled to a power modulator including a pulse width modulator that modulates an incoming DC power before the power is delivered to power said light emitting diode.

7. The system as recited in claim 1, wherein the output of the comparator is coupled to a power modulator including a bit stream modulator that modulates an incoming DC power before the power is delivered to power said light emitting diode.

8. The system as recited in claim 1, wherein the output of the comparator is coupled to a secondary winding of a power transformer through a switch, wherein said switch further includes a power transistor.

9. A light emitting diode lighting system comprising:

(a) at least one light emitting diode;

(b) a power supply; and (c) a closed feedback loop connected between an output and a first input of a comparator pertaining to controlling operating temperature of said light emitting diode to oscillator around a predetermined value, said first input is coupled to an output of a temperature sensor pertaining to measuring temperature of said light emitting diode, said predetermined value is set by a second input of the comparator.

10. The system as recited in claim 9, wherein the output of the comparator is coupled to a power modulator including a pulse width modulator that modulates an incoming DC power before the power is delivered to power said light emitting diode.

11. The system as recited in claim 9, wherein the output of the comparator is coupled to a power modulator including a bit stream modulator that modulates an incoming DC power before the power is delivered to power said light emitting diode.

12. The system as recited in claim 9, wherein the output of the comparator is coupled to a secondary winding of a power transformer through a switch, wherein said switch further includes a power transistor.

13. The system as recited in claim 9, wherein said second input of the comparator is coupled to an ambient temperature sensor.

14. The system as recited in claim 9, wherein said second input of the comparator is coupled to a reference generated by a controller.

15. The system as recited in claim 14, wherein said reference is adjustable by a remote control device.

16. A light emitting diode lighting system comprising:

(a) at least one light emitting diode;

(b) a power supply;

(c) a closed feedback loop connected between an output and a first input of a comparator pertaining to controlling operating temperature of said light emitting diode to oscillator around a predetermined value;

(d) a controller; and (e) a remote control device pertaining to determining said predetermined value through adjusting a reference coupled to a second input of the comparator by the controller.

17. The system as recited in claim 16, wherein said first input is coupled to an output of a temperature sensor pertaining to measuring temperature of said light emitting diode, said predetermined value is set by a second input of the comparator.

18. The system as recited in claim 17, wherein said temperature sensor comprises an infrared sensor.

19. The system as recited in claim 16, wherein the output of the comparator is coupled to a power modulator including a pulse width modulator or a bit stream modulator that modulates an incoming DC power before the power is delivered to power said light emitting diode.

20. The system as recited in claim 16, wherein the output of the comparator is coupled to a secondary winding of a power transformer through a switch, wherein said switch further includes a power transistor.

* * * * *